US008091390B2

(12) United States Patent
Houtz

(10) Patent No.: US 8,091,390 B2
(45) Date of Patent: Jan. 10, 2012

(54) HIDE FOLDING SYSTEM AND METHOD

(75) Inventor: Ronn A. Houtz, Wichita, KS (US)

(73) Assignee: Cargill, Incorporated, Wayzata, MN (US)

( * ) Notice: Subject to any disclaimer, the term of this patent is extended or adjusted under 35 U.S.C. 154(b) by 229 days.

(21) Appl. No.: 12/310,151

(22) PCT Filed: Aug. 16, 2007

(86) PCT No.: PCT/US2007/076083

§ 371 (c)(1),
(2), (4) Date: Nov. 23, 2009

(87) PCT Pub. No.: WO2008/022248

PCT Pub. Date: Feb. 21, 2008

(65) Prior Publication Data

US 2010/0058818 A1 Mar. 11, 2010

Related U.S. Application Data

(60) Provisional application No. 60/822,591, filed on Aug. 16, 2006.

(51) Int. Cl.
*C14B 1/00* (2006.01)

(52) U.S. Cl. ..... 69/33

(58) Field of Classification Search ..... 69/1, 21, 69/33, 47; 356/72; 382/111
See application file for complete search history.

(56) References Cited

U.S. PATENT DOCUMENTS 1,564,317 A 12/1925 Blade
1,661,571 A 3/1928 MacDonald
2,526,691 A 10/1950 Roske
2,623,291 A 12/1952 Randal et al.
2,623,292 A 12/1952 Randal et al.
2,729,964 A 1/1956 Brown
2,837,198 A 6/1958 Griffin
2,884,244 A 4/1959 Bowman
3,405,932 A 10/1968 Dame
3,567,047 A 3/1971 Clausen
3,593,991 A 7/1971 Baron
4,051,569 A 10/1977 Freeman
4,060,734 A * 11/1977 Tilley et al. ..... 250/559.27
4,199,255 A 4/1980 Wilson et al.
4,478,328 A 10/1984 Heiland
4,550,905 A 11/1985 Heiland (Continued)

FOREIGN PATENT DOCUMENTS

DE 0273421 A1 11/1989

(Continued)

OTHER PUBLICATIONS

Makino Hirshki, Automatic machine design is attained by mastering the handling of difficult to supply articles. Explanation 2. Secret of flexible article handling, Machine Design, 2004, 24-29, 48-9 (and English translation).

(Continued)

*Primary Examiner* — Shaun R Hurley

(57) ABSTRACT

The present invention is a method and system for processing animal hides in a meat processing facility. In one embodiment, the system the system includes a grading station for determining hide grades, a measuring station for determining at least one hide dimension of the animal hide, a hide folding station, a stacking station adapted to deposit hides at a plurality of stacking sites, a conveyor system and a control system.

24 Claims, 11 Drawing Sheets

U.S. PATENT DOCUMENTS

| | | | | |
|---|---|---|---|---|
| 4,781,369 | A | 11/1988 | Mathias | |
| 4,929,296 | A | 5/1990 | Zorzolo | |
| 5,050,409 | A | 9/1991 | Allamanche | |
| 5,695,313 | A | 12/1997 | Gross | |
| 6,157,730 | A * | 12/2000 | Roever et al. | 382/110 |
| 2003/0059090 | A1 | 3/2003 | Zhang et al. | |

FOREIGN PATENT DOCUMENTS

| | | | |
|---|---|---|---|
| EP | 0198777 | A1 | 10/1986 |
| EP | 0219108 | | 10/1988 |
| EP | 0168846 | B1 | 5/1989 |
| EP | 0331863 | A1 | 9/1989 |
| EP | 1077191 | A1 | 2/2001 |
| EP | 0907754 | B1 | 8/2003 |
| EP | 1012085 | B1 | 11/2003 |
| EP | 1590490 | A2 | 11/2005 |
| GB | 1082170 | A | 9/1967 |
| GB | 1558367 | A | 12/1979 |
| SU | 505598 | A | 3/1976 |

OTHER PUBLICATIONS

Mozafar Saadat, Industrial applications of automatic manipulation of flexible materials, Industrial Robot: an International Journal, 2002, 434-442, 29-5, MCB UP Ltd.

* cited by examiner

| GRADE | WEIGHT | | |
|---|---|---|---|
| 1 | HEAVY | MEDIUM | LIGHT |
| 2 | HEAVY | MEDIUM | LIGHT |
| 3 | | | |
| NATIVE | | | |

Fig. 7

HIDE FOLDING SYSTEM AND METHOD

FIELD OF THE INVENTION

The present invention relates to systems and methods for processing animal hides in a meat processing facility. More specifically, embodiments of the present invention relate to automated processes and systems for curing, grading, measuring, folding and stacking animal hides prior to delivering the hides to a tannery.

BACKGROUND

During commercial meat production in a meat processing facility, an animal (e.g., bovine, porcine, and ovine) carcass is subjected to a number of different procedures. For example, during commercial beef production, an animal is stunned and hung from a conveyor system, such as a trolley running along an overhead rail. The animal is then exsanguinated by severing the arteries at the base of the neck. Next, the animal's hide is removed. Removing the animal's hide typically involves several steps, including making a series of cuts along a hide removal pattern. Portions of the hide are then partially removed by alternating manual and automated steps. The animal is then transported to a downpuller, which engages these partially removed portions of the hide and exerts a downward force on the hide, thereby pulling the remainder of the hide from the animal's carcass.

After removal, the hide is preserved by a process commonly referred to as "curing." Commercial curing processes generally involve the application of a salt brine to the hide via a tumbler or similar system in order to prevent bacteria from affecting the quality of the hide, and thus, the quality of leather made from the hide. After curing, the hides are advanced along a trolley conveyor to a folding station, where each hide is visually graded for size and quality, manually folded and then stacked on a pallet along with other similarly graded hides for shipping.

Several challenges are presented by this grading and folding process. For example, the process requires significant manual labor. Additionally, hide graders are given a very short period of time just prior to folding to make a grade determination. This results in a significant number of grading errors and/or inconsistencies, which can adversely affect the quality and/or consistency of hides that are delivered to the tannery.

BRIEF SUMMARY OF THE INVENTION

One embodiment of the present invention is a system for processing animal hides. The system includes a grading station for determining hide grades, a measuring station for determining at least one hide dimension of the animal hide, a hide folding station, a stacking station adapted to deposit hides at a plurality of stacking sites, a conveyor system and a control system.

The control system includes a grading station interface, a measuring system interface, a stacking station interface and a microprocessor. The control system is adapted to receive the hide grades and measurements, compare the grades and or measurements with a predetermined protocol and to selectively deposit the hides at one of the plurality of stacking sites based on the comparison.

Another embodiment of the present invention includes a method for processing an animal hide in a meat processing facility. The method includes the steps of assigning a hide identifier, grading the hide, measuring the hide, storing the grades and/or measurements, folding the animal hide, advancing the folded hide to a stacking station having a plurality of stacking sites, comparing the hide grade and/or hide measurement information to a stacking protocol to select a stacking site and depositing the hide at the selected stacking site.

BRIEF DESCRIPTION OF THE DRAWINGS

FIG. 7 is a hide grading and measuring protocol according to embodiments of the present invention.

DETAILED DESCRIPTION

Figure 1:
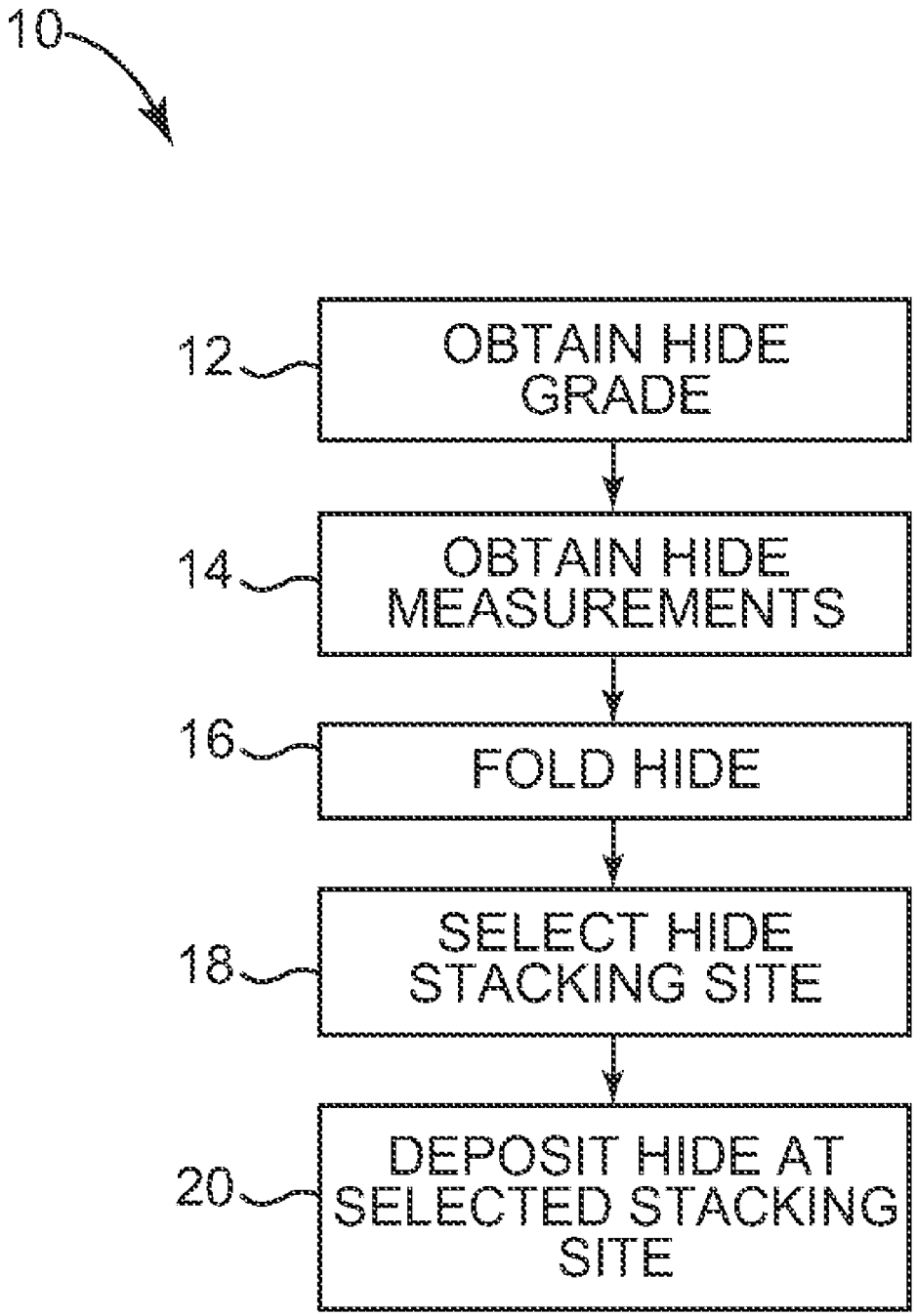
FIG. 1 is a flow chart showing a method of processing cured animal hides according to one embodiment of the present invention.

FIG. 1 is a flow-chart of a method 10 for processing cured animal hides according to one embodiment of the present invention. After an animal hide is received from a curing operation, the hide is laid flat and a hide grade (block 12) and one or more hide measurements (block 14) are obtained. The hide is then folded (block 16) and delivered to a stacking station, which includes a plurality of hide stacking sites. One of the plurality of stacking sites is selected based on the obtained hide grade and/or measurement (block 18). The hide is then deposited at the selected stacking site (block 20). Optional steps that may also be performed as part of this method include a moisture removal step and a disinfecting step. Although FIG. 1 indicates that the described processing steps are carried out in a particular order, the steps could be carried out in a variety of different orders according to embodiments of the present invention.

Figure 2:
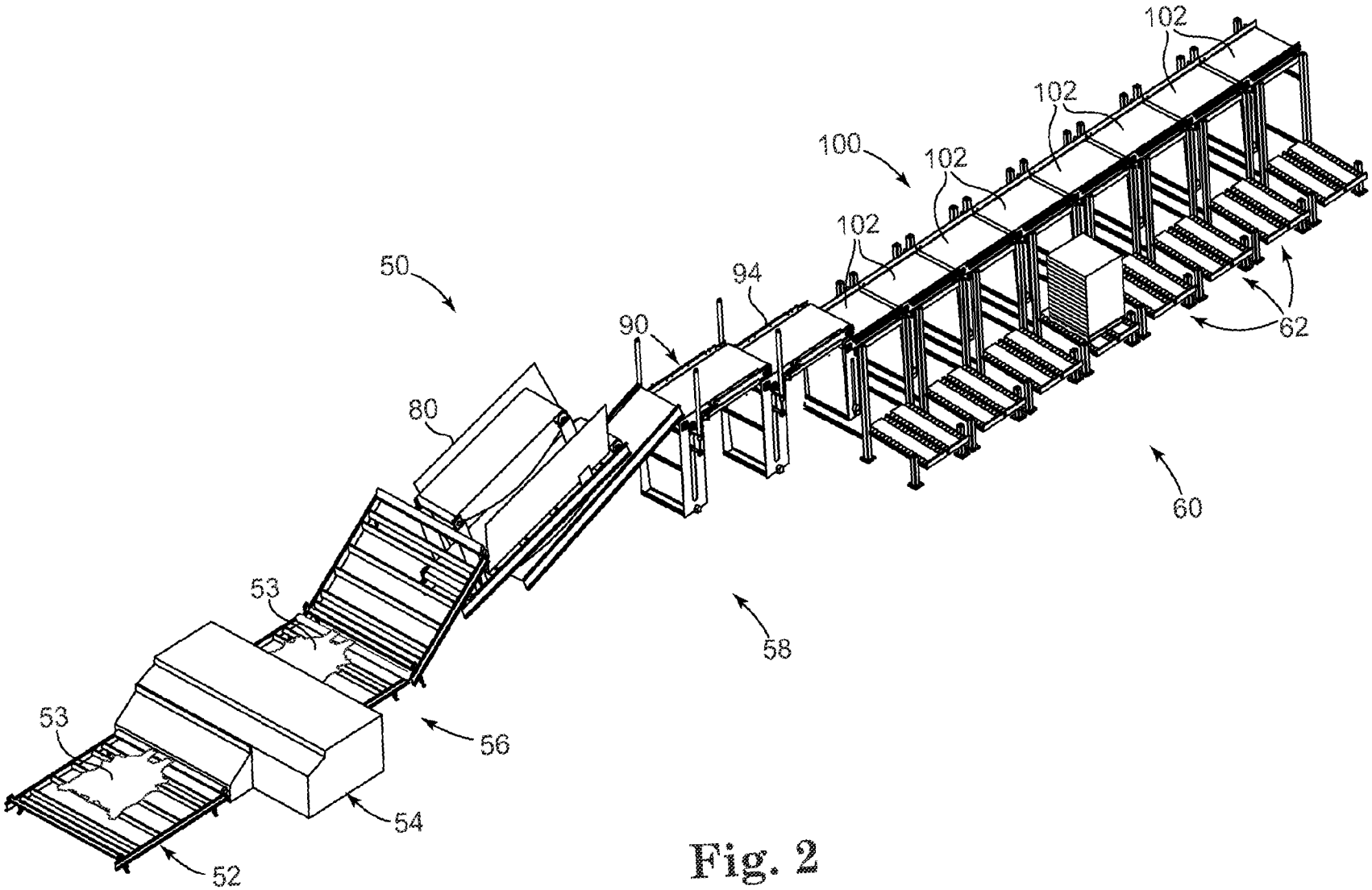
FIG. 2 is a perspective view of a hide processing system according to one embodiment of the present invention.

FIG. 2 illustrates a system 50 for carrying out the processing method according to an embodiment of the present invention. The system 50 includes a hide grading station 52, a hide press 54, a measuring station 56, a hide folding station 58 and a hide stacking station 60 including a plurality of hide stacking sites 62. Each component of the system 50 is discussed in detail below.

Hide Grading Station

As illustrated in FIG. 2, the hide grading station 52 generally includes a horizontal conveyor or similar workspace upon which hides 53 may be positioned for grading. In one embodiment, hides 53 are advanced from the curing operation to the grading station 52 via an overhead conveyor system (not shown). The hide 53 can be automatically or manually transferred from the overhead conveyor to the grading station 52 by conventional methods.

At the grading station 52, the hide 53 is laid flat (e.g., flesh side down, hair side up) and a hide grade is obtained. In one embodiment, a qualitative hide grade determination (e.g., Grade 1, Grade 2, Grade 3, or Native) is made by a grader and recorded. In an alternate embodiment, the hide 53 is graded using machine vision equipment, which could automatically assign a hide grade based on a recorded representation of the hide. As discussed in detail below, hide grades are used at the hide stacking station 60 to select a particular hide stacking site 62 to deposit a hide 53.

Hide Press

The hide press 54 removes excess moisture from hides 53 that is naturally present and/or absorbed during the curing process. In the illustrated embodiment, the hide press 54 is a horizontal press that utilizes a series of rollers to squeeze moisture out of the hide. An example of a commercially available press is the Rizzi brand Sammying Machine (Modena, Italy). Removing excess moisture prior to folding may reduce bacterial levels, particularly along the hide crease lines created during the subsequent hide folding step.

Measuring Station

The measuring station 56 is used to obtain weight and/or other measurements of the hide 53. Like the hide grade, measurements taken from each hide 53 may be used in selecting a stacking site 62 onto which a hide 53 is to be deposited. Hide dimension data may also be useful for quality control, marketing and/or sales.

The measuring station 56 according to certain embodiments is capable of automatically measuring the length, width, thickness and/or weight of the hides 53 using various sensors including, for example, photoelectrics, proximity sensors, vision technology, electronic scales, etc. In other embodiments, certain measurements may be performed manually or not at all.

Figure 3:
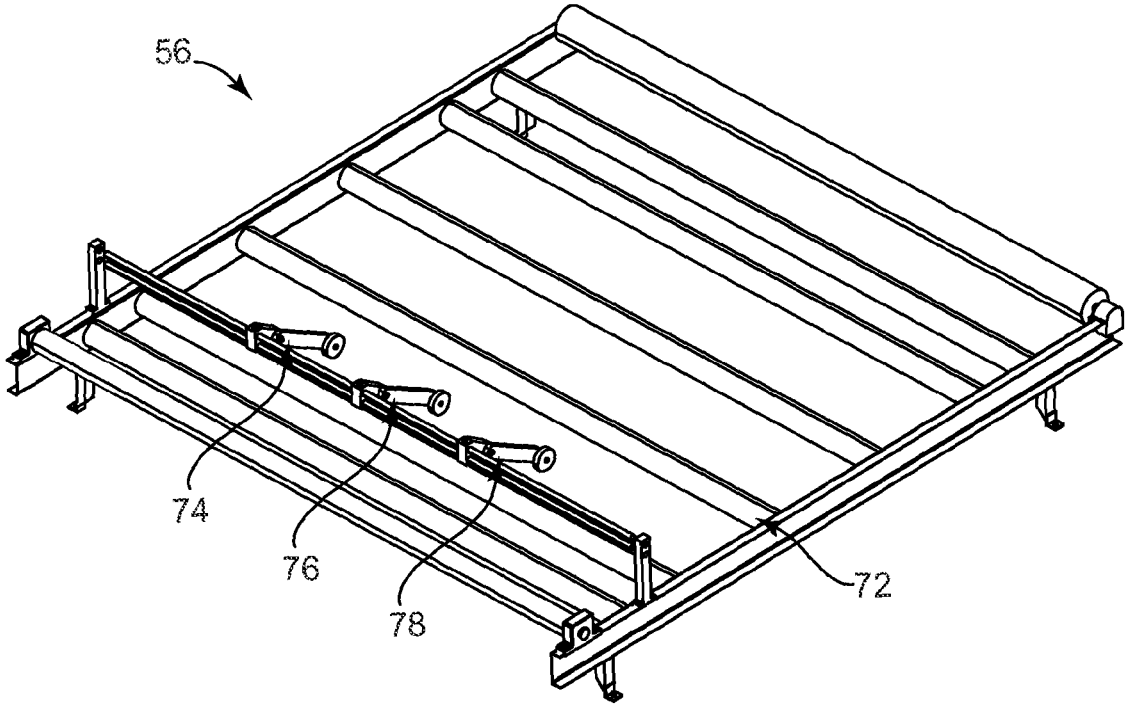
FIG. 3 is a perspective view of a hide measuring table according to embodiments of the present invention.

FIG. 3 illustrates a suitable measuring station 56 according to one embodiment of the present invention, which includes a conveyor 72 for advancing the hides 53 and roller sensors 74, 76, and 78 that determine and record the length, width and/or thickness of the hide 53. The roller sensors 74, 76 and 78 can be used to determine the thickness by measuring the distance that one or more of the rollers is raised from the table when a hide initially passes under the rollers. Length can be determined by the number of roller revolutions that occur when the roller is raised and/or the amount of time the rollers remain raised (assuming that the speed of the conveyor is known). The width can be determined by spacing the rollers such that each roller does not contact the hide unless the hide has a certain width.

In one embodiment, the measuring station 56 could utilize photocells and or machine vision technology to determine the hide length, width and/or thickness dimensions. To determine hide weight, the conveyor 72 could be supported by load cells (not shown), which make and record a weight determination each time a hide 53 passes over the conveyor 72. In another embodiment, hide grading and hide measurement could take place at the same station.

Hide Disinfecting

Prior to folding the hide, embodiments of the present invention include an optional disinfecting step (not shown) wherein a disinfectant such as a chlorine mist is applied to either or both sides of the hide to reduce bacterial contamination. This step could be performed using conventional disinfectant applicators (e.g., misters, sprayers, etc.).

Hide Folding Station

Figure 4:
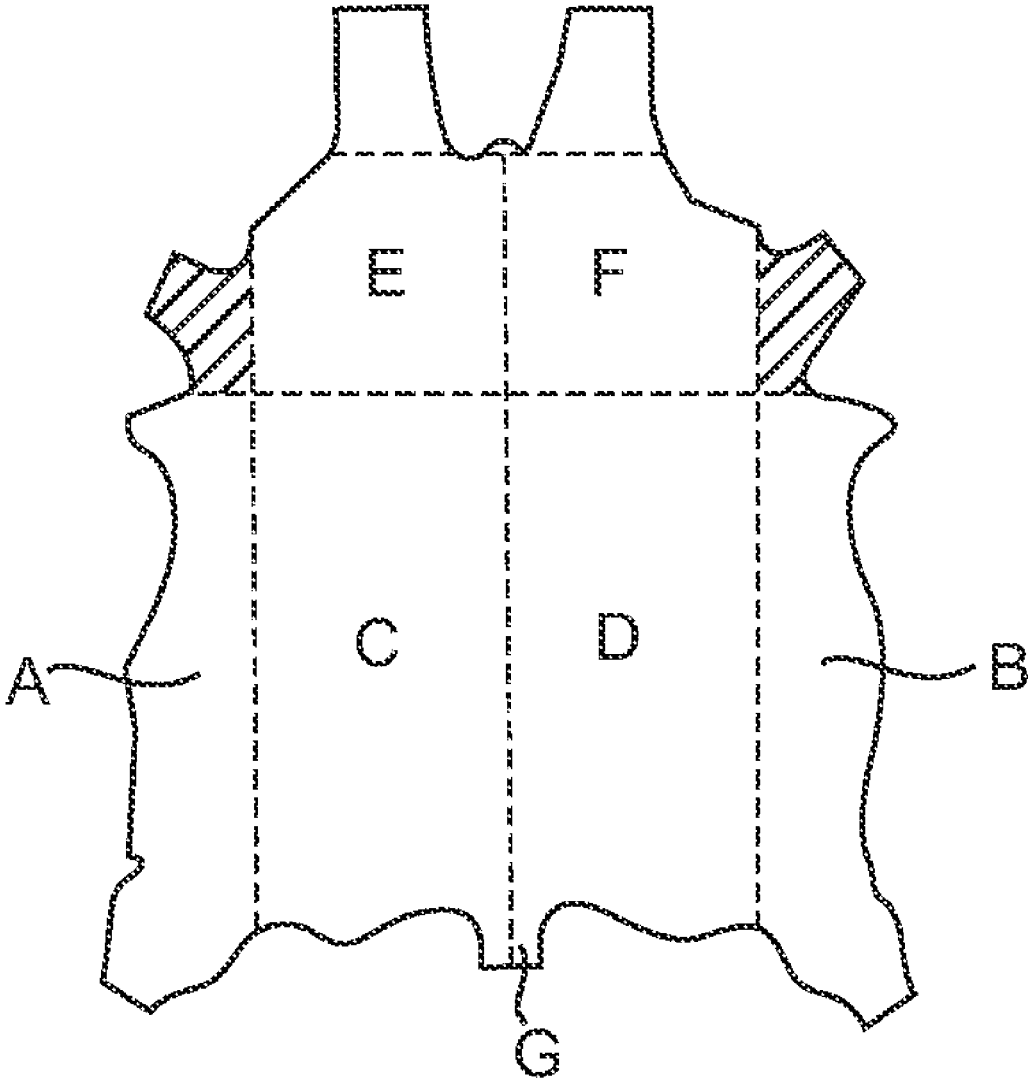
FIG. 4 is top view of a hide folding guide suitable according to embodiments of the present invention.

After determining the hide dimensions, the hide 53 is automatically folded at the hide folding station 58 (see FIG. 2). In one embodiment, the hide 53 is folded along one or more of fold lines as illustrated in FIG. 4. For example, the hide 53 is first folded such that left and right belly sections A and B are folded over or under the main body sections C and D to reduce the width of the hide to approximately 38-40 inches. Next, the head sections E and F and tail section G are folded over or under the main body section A and B to produce a roughly 38-40 inch folded hide square.

Figure 5:
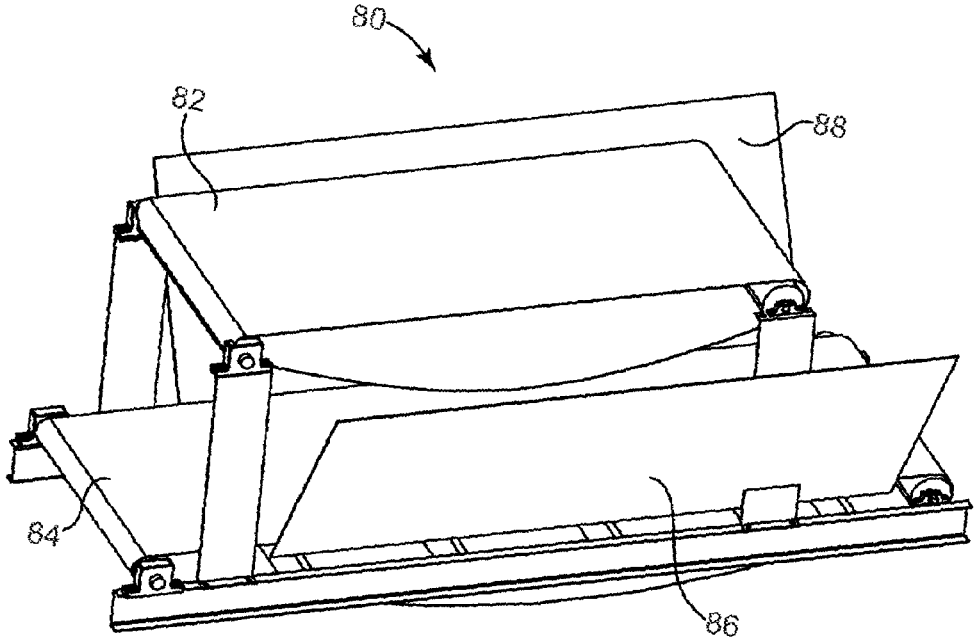
FIG. 5 is a perspective view of a hide folding device according to embodiments of the present invention.

FIG. 5 shows an automatic hide folder 80 according to one embodiment of the present invention for folding the sides of the hide. The hide folder 80 includes an upper conveyor 82, a lower conveyor 84 and rails 86 and 88. A hide is initially advanced up to and along the upper conveyor 82, which is sufficiently narrow (e.g., 38-40 in.) to allow the hide sides to hang down over the sides of the conveyor 82. These sides are guided by the rails 84 and 86 such that when the hide drops to the lower conveyor 82, the sides tuck under the main hide sections. Although FIG. 5 shows conveyors 82 and 84 as being substantially parallel, the conveyors could also converge to transfer the hide. Alternatively, the rails 84, 86 could be configured such that the sides of the hide fold over the main hide sections.

Figure 6:
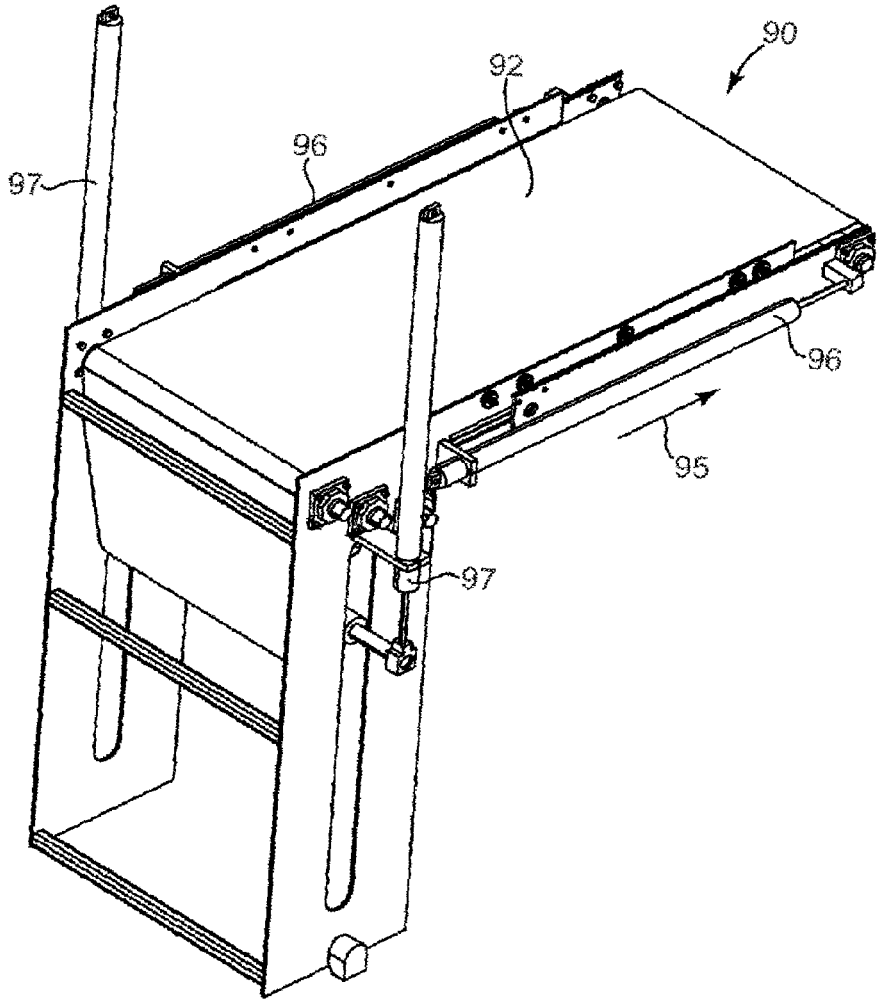
FIG. 6 is a perspective view of a hide folding device according to embodiments of the present invention.

FIG. 6 illustrates a hide folder 90 suitable for folding the head or tail portions of the hide. The hide folder 90 includes a retracting conveyor 92. This conveyor is positioned adjacent a second conveyor 94 (See FIG. 2). As the hide transfers to the second conveyor, the foremost portion of the hide (e.g., the head) contacts the second conveyor 94. At the same time, the retracting conveyor 92 is extended toward the second conveyor 94 in direction 95 to produce a reduced relative speed between the conveyors. The momentum of the hide 53 as it contacts the second conveyor 94 causes the head to fold under the main portion of the hide.

The extension of the retracting conveyor 92 is accomplished via horizontal pistons 96 and vertical pistons 97, which extend (and retract) the conveyor 92. Alternatively, two conveyors operating at different actual speeds or moving in opposite directions could be employed to accomplish a similar result.

The reverse approach can be taken to fold the tail after folding the head. For example, after folding the head portion by extending, the retracting conveyor could be retracted as the tail is transferred to the second conveyor 94. The relative speed difference in this case would again fold the tail over the main body. In another embodiment, the second conveyor 94 could change speeds or reverse directions relative to retracting conveyor 92. In yet another embodiment, the second conveyor 94 could also be a retracting conveyor and fold the tail by retracting as the hide 53 is conveyed to the stacking station 60.

Stacking Station

After folding, the hides are advanced to the stacking station 60, where the hide grade and/or measurement information is used to selectively deliver the hide to a particular hide stacking station 62 along conveyor 100. In one embodiment, each hide stacking station 62 is assigned a predetermined hide grade and/or measurement such that hides 53 having corresponding grades and or measurements are deposited at the appropriate stacking site 62. The number of stacking sites used depends on a variety of factors include the grading method, the number and type or measurements obtained, space limitations and/or customer preferences. In one embodiment, between six and twelve stacking sites are utilized.

FIG. 7 is an exemplary hide quality scale that can be employed with embodiments of the present invention. Hide grade is included along the vertical column of the scale and includes four possible grades listed in decreasing order of hide quality. Three hide weight categories are provided along the horizontal row such that up to twelve stacking categories are available. In the illustrated scale, weight determinations are not made for hides identified as being grade 3 or native grade such that up to eight stacking categories are provided.

From this scale, a stacking site protocol can be established. In one stacking protocol, the number of stacking sites corresponds directly with the number or stacking categories in the scale. In another protocol, certain stacking categories may be the basis for multiple stacking sites and/or one stacking site may encompass multiple categories.

Each stacking site includes one or more pallets which are configured to receive multiple hides. Once full, the pallets are transferred via forklift or similar methods for further processing, storage and/or distribution. In an alternate embodiment, pallet systems described in U.S. published application 20070006782, which is incorporated herein by reference in its entirety could be utilized in place of traditional pallets.

Figure 8:
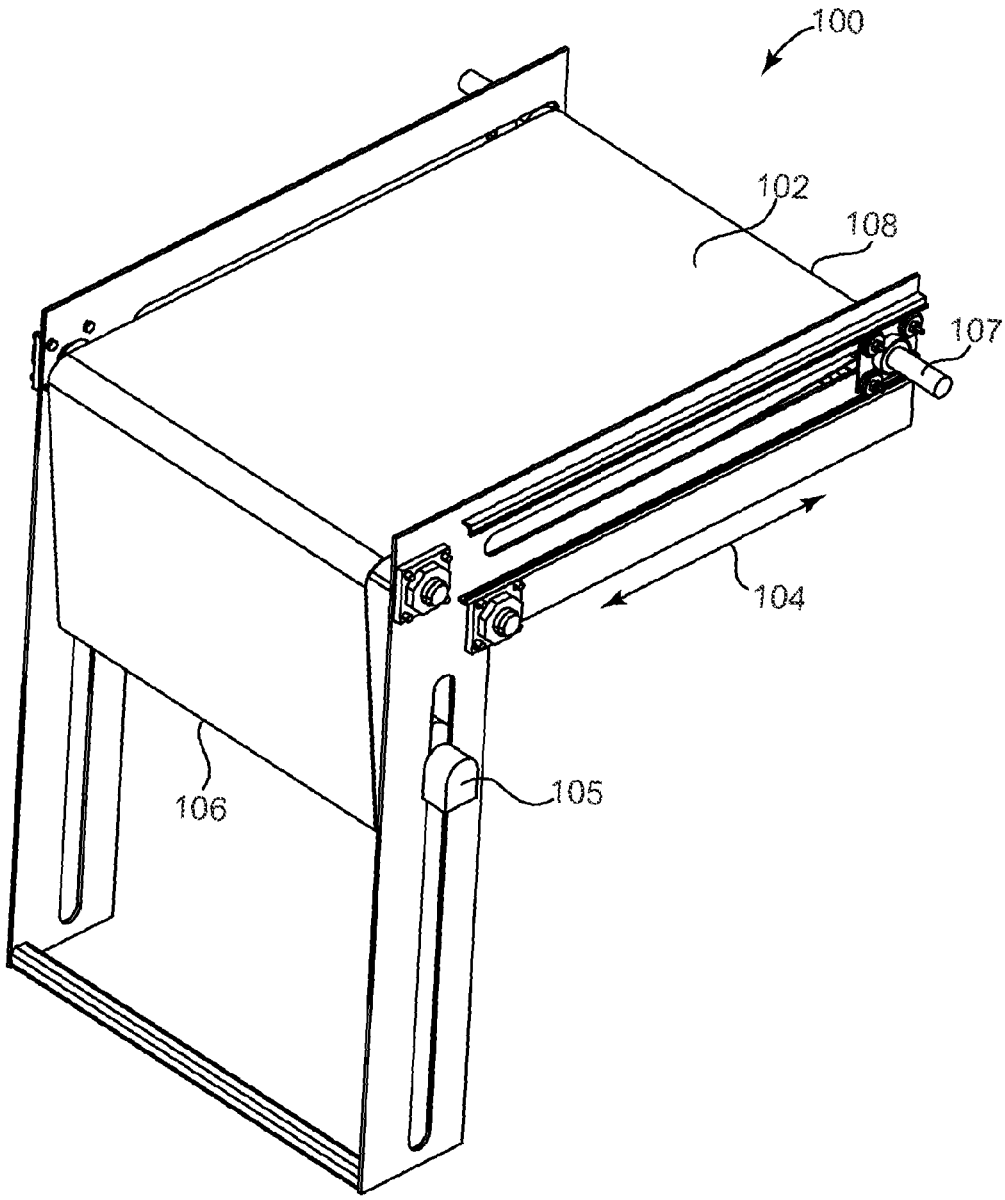
FIG. 8 is a perspective view of a system for stacking hides according to embodiments of the present invention.
Figure 9:
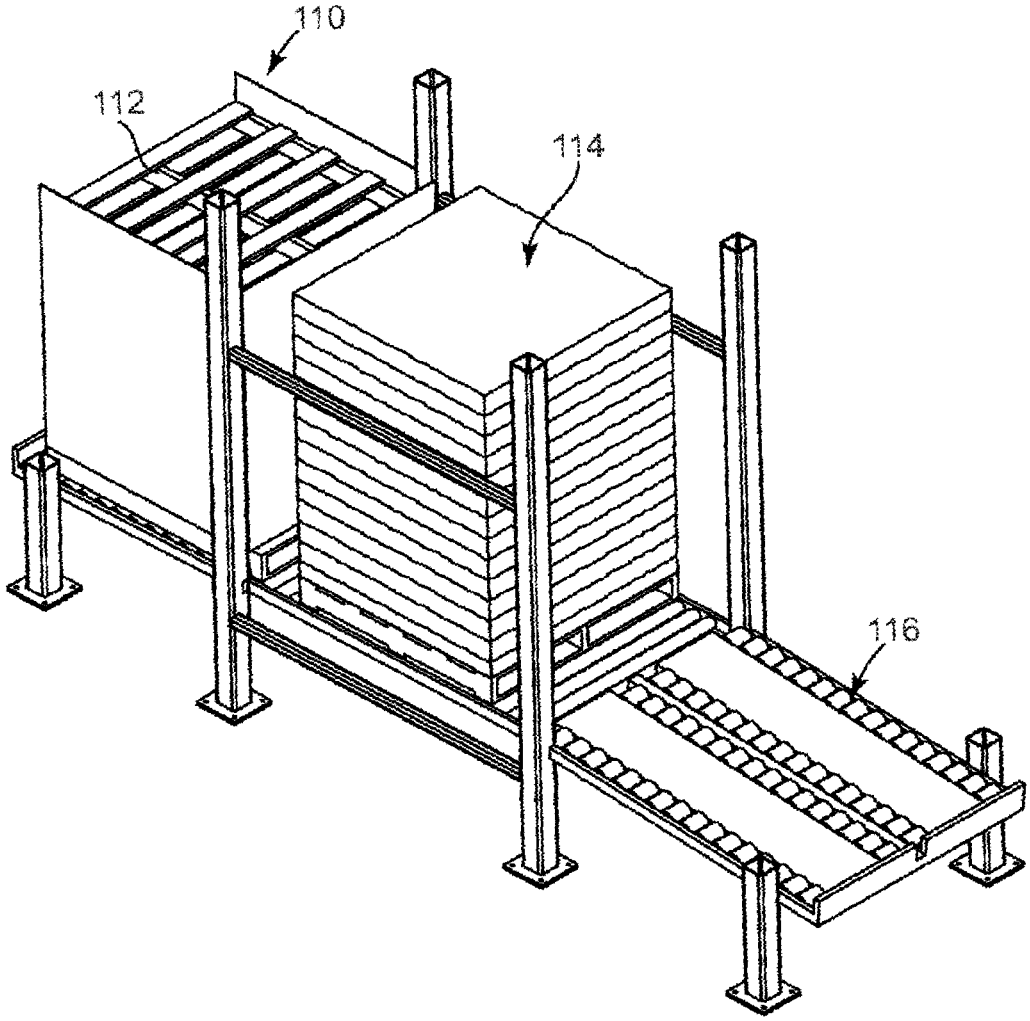
FIG. 9 is a perspective view of a system for stacking hides according to embodiments of the present invention.
Figure 10:
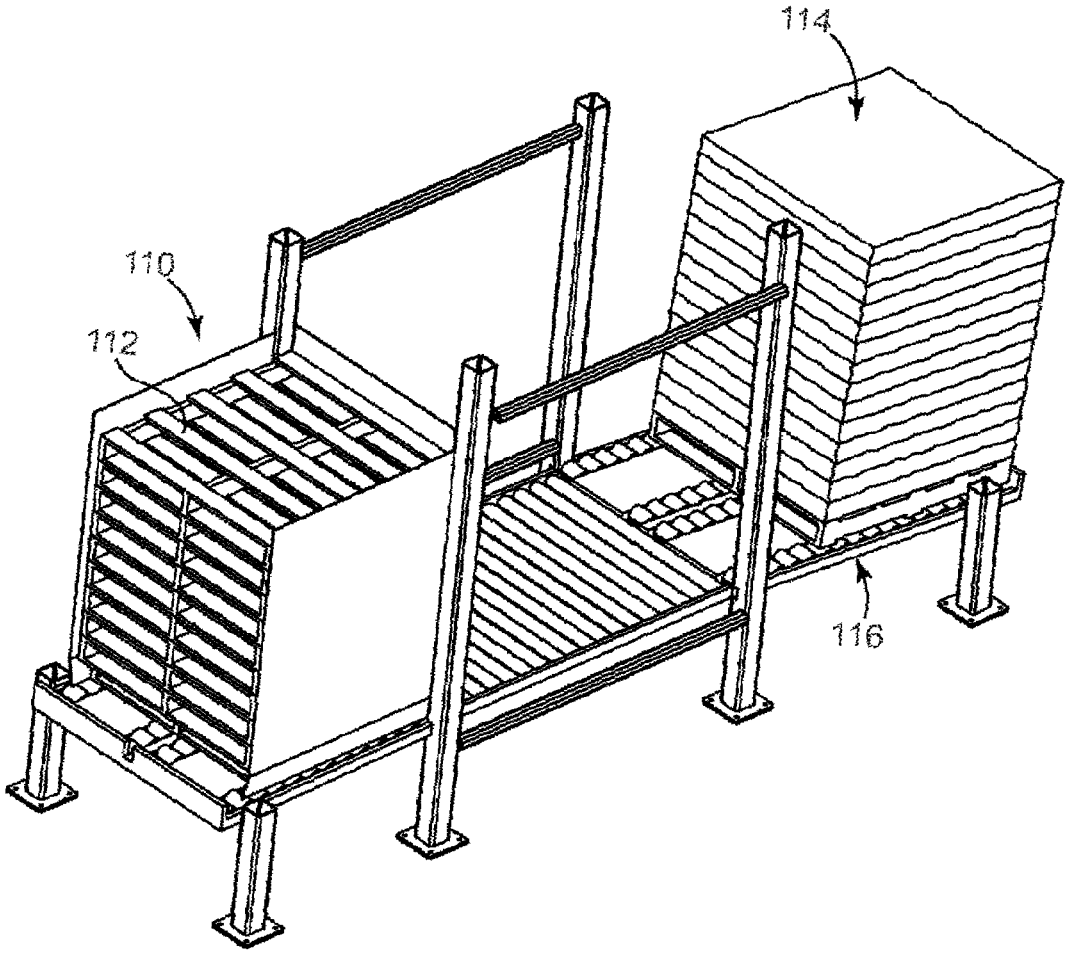
FIG. 10 is a perspective view of a system for stacking hides according to embodiments of the present invention.

FIGS. 8-10 illustrate various embodiments of the hide stacking station 60 and stacking sites 62. FIG. 8 illustrates an embodiment of the present invention for automatically depositing the hides 53 onto pallets situated directly below the conveyor 100. The illustrated portion of conveyor 100 includes a retracting conveyor belt 102 capable of extending and retracting along a horizontal plane as indicated by arrow 104. The retracting conveyor belt 102 moves in conjunction with axel 105 at a proximal end 106 and axel 107 at distal end 108. The station 60 shown in FIG. 2 includes a series of these retracting conveyors 102 arranged to provide continuous advancement of the hide 53 along conveyor 100. Each retracting conveyor belt 102 can retract to deposit the hide onto a pallet at a stacking site 62 positioned below the conveyor 100 as shown in FIG. 2.

FIGS. 9-10 are schematic illustrations showing the manner in which pallets are configured to receive hides from the conveyor 100 shown in FIG. 8. A pallet 110 begins at the upward position 112 when empty. As hides are stacked, the pallet 110 begins to index downwardly such that each hide dropped onto the pallet falls the same distance. A full pallet 114 is advanced onto an out-feed table 116, and is replaced by another empty pallet 110.

Control System

Figure 11:
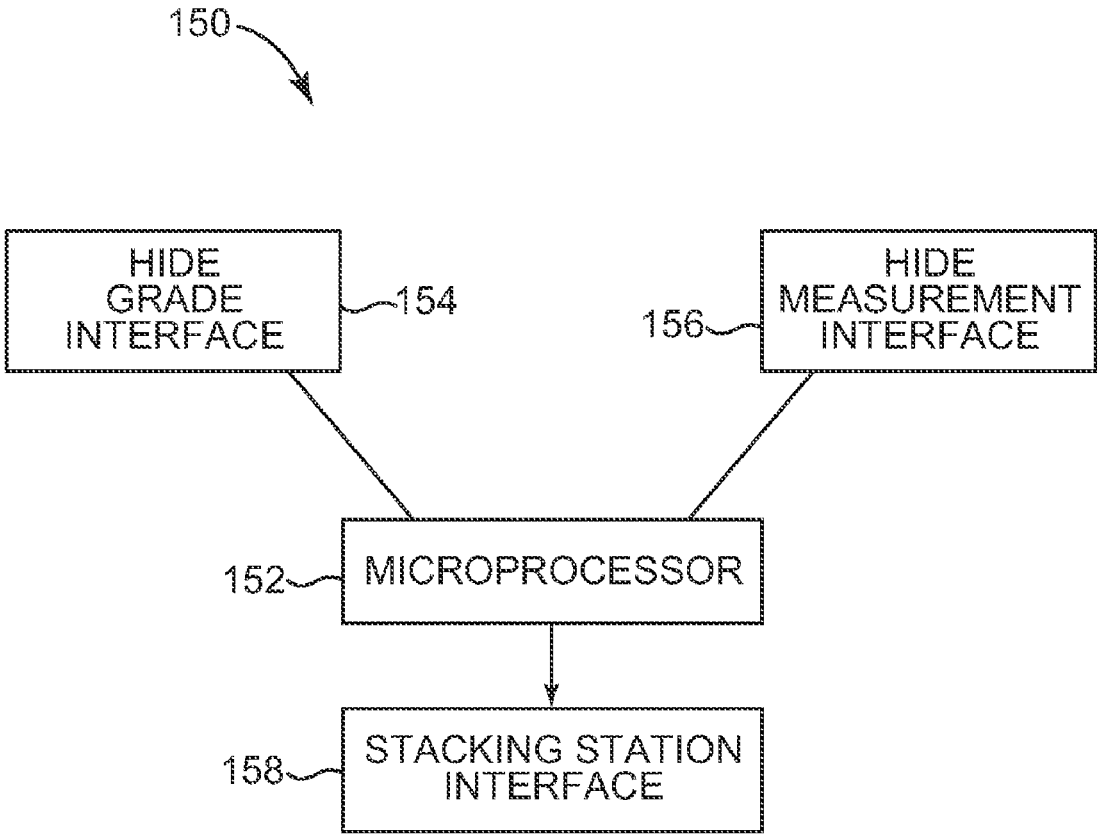
FIG. 11 is a schematic illustration of a control system according to embodiments of the present invention.

In one embodiment, hides 53 are selectively deposited at predetermined stacking sites 62 using a control system. FIG. 11 is a schematic illustration of one such control system 150, which includes a microprocessor 152, a hide grade interface 154, a hide measurement interface 156 and a stacking station interface 158.

The microprocessor 152 can be any microprocessor capable of communicating with the interface components to carry out the control functions detailed below. In one embodiment, the microprocessor is configured to associate information relating to the processed hides (e.g., grade, weight, length, etc.) with a unique identifier in, for example, an electronic database. This identifier could also be associated with information relating to the source carcass.

Hide identifiers can be assigned in a variety of ways. In one embodiment, each processed hide 53 is assigned sequential numeric or letter identifiers. In another embodiment, identifiers assigned to the hide during curing are used. In a further embodiment, identifiers originally assigned to the source animal or carcass are used. In these embodiments, information related to a hide could then be associated with other information relating to the corresponding animal and/or carcass. In one embodiment, these identifiers are assigned at the grading station, for example, at the time a hide grade is entered. By employing a first-in, first-out method, the microprocessor could track hides through the processing steps. In other embodiments, various electronic or mechanical sensors could be used to assign identifiers and/or track identified hides.

In another embodiment, electronic tracking identification such as bar codes tags, RFID tags or similar electronic identifiers could be associated with each hide. In this embodiment, various sensors or readers in communication with the microprocessor 152 could be used.

The hide grade interface 154 is configured to obtain or receive a hide grade such that each hide grade can be associated with the corresponding hide identifier in an electronic database or the like. For example, the hide grade interface 154 may include a computer terminal or a similar processor interface via which the grader can enter and record a grade determination for subsequent use at the stacking station 60. In another embodiment, the interface may include one or more buttons designating a particular grade. In a further embodiment, a default grade is recorded unless a different grade is entered into the interface. In yet a further embodiment, the hide grade interface 154 includes machine vision equipment that automatically determines a hide grade. In each case, the interface may be in communication with the microprocessor 152, in order to associate the hide grade with the hide identifier corresponding to the graded hide in, for example, an electronic database.

The hide measurement interface 156 is configured to obtain and/or receive one or more hide measurements in order to associate such measurements with the corresponding hide identifier. In one embodiment, the hide measurement interface 156 includes the various measurement sensors (e.g., weight, length, width, etc.) described above with respect to the hide measurement station 56. In another embodiment, the hide measurement interface 156 includes one or more user interfaces into which such measurements can be entered. In either case, the hide measurement interface 156 may be in communication with the microprocessor 152 in order to associate the hide measurements with the hide identifier corresponding to the measured hide in, for example, an electronic database.

The stacking station interface 158 is configured to receive instructions from the microprocessor and to operate the stacking station to selectively deposit hides 53 at selected stacking sites 62 based on the stacking protocol and the recorded hide grade and/or hide measurement associated with that hide's identifier. For hide stacking station 60, for example, the stacking station interface 158 operates the conveyor 100 to convey the hide 53 to a selected stacking site 62 and to retract the retracting conveyor 102 such that the hide 53 is deposited onto a pallet at the selected stacking site 62.

In one embodiment, the control system 150 functions as follows. The hides 53 are assigned an identifier, prior to or at the time of grading, which is received by the microprocessor 152 and recorded in an electronic database. The hide grade and hide measurements are then determined, entered into and/or recorded by the hide grade interface 154 and hide measurement interface 156. The microprocessor 152 receives the hide grade and hide measurement information and associates it with the appropriate hide identifier in the electronic database. After each hide 53 is folded and conveyed to the stacking station, the hide 53 is identified by its hide identifier and the associated hide grade and hide measurement information is accessed. The accessed information is then compared to a hide stacking protocol and a stacking site is selected. The microprocessor 152 then instructs the stacking station interface 158 to operate conveyor 100 to convey the hide 53 to the selected stacking station and to retract the retracting conveyor 102 to deposit the hide onto a pallet. In one embodiment, when a pallet at a stacking station is full such as shown in FIG. 9, the stacking station interface 158 operates the conveyors at the stacking site to convey the full pallet to the out-feed table 116.

The invention claimed is:

1. An automated system for processing a plurality of animal hides in a meat processing facility, comprising:

a grading station for determining at least one grade for each hide;

a measuring station for determining at least one measurement for each hide;

a folding station for folding the hides;

a stacking station adapted to deposit hides at a plurality stacking sites;

a conveyor system for advancing the hides between the grading, measuring folding and stacking sites; and a control system including:

a grading station interface adapted to receive hide grades, a measuring station interface adapted to receive hide measurements, a stacking station interface adapted to selectively deposit hides at stacking sites, and a microprocessor adapted to compare the received hide grades, hide measurements or both with a predetermined stacking protocol, to select a stacking site for each hide and to instruct the stacking station interface to selectively deposit hides at the selected stacking sites.

2. The system of claim 1 wherein the microprocessor is adapted to assign an identifier to each processed hide and to associate the received hide grade or hide measurement of each processed hide with the corresponding identifier.

3. The system of claim 2 wherein the microprocessor is adapted to associate the identifier with the corresponding hide grade, hide measurement or both in an electronic database.

4. The system of claim 1 further comprising a press station for removing moisture from the hides prior to folding.

5. The system of claim 1 wherein the folding station is configured to automatically fold the hides to a predetermined shape and size.

6. The system of claim 1 wherein the conveyor system includes at least one conveyor having a generally flat surface upon which the hides reside.

7. The system of claim 1 wherein the hide stacking station comprises at least one retracting conveyor adapted to selectively retract to form an opening to deposit hides at one of the plurality of stacking sites.

8. The system of claim 7 wherein a plurality of retracting conveyors are linearly disposed to form openings at each stacking site.

9. The system of claim 7 wherein the at least one retracting conveyor is selectively opened by the control system.

10. A method for automated processing of an animal hide in a meat processing facility comprising:

assigning a hide identifier to the hide;

determining a grade of the hide;

determining a measurement of the hide;

storing the determined hide grade and hide measurement with the hide identifier in an electronic database;

folding the animal hide to a predetermined shape and size;

advancing the folded hide to a stacking station having a plurality of hide stacking sites;

comparing the stored hide grade, hide measurement or both to a stacking protocol to select a stacking site;

depositing the folded hide at the selected stacking site.

11. The method of claim 10 wherein the hide identifier is assigned prior to or during grading.

12. The method of claim 10 wherein the step of determining the hide grade includes entering the hide grade into a computer terminal and recording the hide grade and associated hide identification in an electronic database.

13. The method of claim 10 wherein the step of determining the hide measurement includes receiving at least one hide measurement from a measurement sensor and recording the at least one hide measurement in a database.

14. The method of claim 10 wherein the comparing step is carried our by a microprocessor, and wherein the microprocessor instructs the stacking station to deposit the hide at the selected stacking site.

15. A system for processing a plurality of animal hides in a meat processing facility, comprising:

means for identifying the hides;

means for grading the hides;

means for measuring the hides;

means for associating the identifying means, the grading means, and the measuring means to record at least one hide grade and hide measurement for each hide;

means for folding the hides; means for conveying the hides to and depositing the hides a plurality of stacking sites;

means for selecting a stacking site for each hide based on the recorded hide grade, hide measurement or both; and means for instructing the conveying means to deposit each hide at a selected stacking site.

16. The system of claim 15 wherein the associating means includes a microprocessor in communication with an electronic database.

17. The system of claim 15 wherein the selecting means includes a microprocessor adapted to compare the recorded hide grade and hide measurement information with a stacking protocol.

18. The system of claim 15 wherein the instructing means includes a microprocessor that instructs the conveying means to deposit each hide at the selected stacking site.

19. The system of claim 1 wherein the microprocessor is adapted to assign an identifier to each processed hide and to associate the received hide grade or hide measurement of each processed hide with the corresponding identifier.

20. The system of claim 1 further comprising a press station for removing moisture from the hides prior to folding.

21. The system of claim 1 wherein the folding station is configured to automatically fold the hides to a predetermined shape and size.

22. The system of claim 1 wherein the hide stacking station comprises at least one retracting conveyor adapted to selectively retract to form an opening to deposit hides at one of the plurality of stacking sites.

23. The system of claim 7 wherein a plurality of retracting conveyors are linearly disposed to form openings at each stacking site.

24. The system of claim 7 wherein the at least one retracting conveyor is selectively opened by the control system.

* * * * *

UNITED STATES PATENT AND TRADEMARK OFFICE

CERTIFICATE OF CORRECTION

PATENT NO. : 8,091,390 B2
APPLICATION NO. : 12/310151
DATED : January 10, 2012
INVENTOR(S) : Ronn A. Houtz It is certified that error appears in the above-identified patent and that said Letters Patent is hereby corrected as shown below:

On the Face Page, in field (57), under "ABSTRACT", in line 3, after "the system" delete "the system".

Signed and Sealed this
Tenth Day of April, 2012

David J. Kappos

David J. Kappos
*Director of the United States Patent and Trademark Office*